US010501885B2

(12) United States Patent
Haselmeier et al.

(10) Patent No.: US 10,501,885 B2
(45) Date of Patent: Dec. 10, 2019

(54) DOMESTIC CLOTHES DRYER AND METHOD FOR DRIVING SUCH DRYERS

(71) Applicant: WHIRLPOOL CORPORATION, Benton Harbor, MI (US)

(72) Inventors: Ralf Haselmeier, Rudersberg (DE); Jurij Paderno, Novate Milanese (IT)

(73) Assignee: Whirlpool Corporation, Benton Harbor, MI (US)

( * ) Notice: Subject to any disclaimer, the term of this patent is extended or adjusted under 35 U.S.C. 154(b) by 216 days.

(21) Appl. No.: 15/586,827

(22) Filed: May 4, 2017

(65) Prior Publication Data

US 2017/0233940 A1 Aug. 17, 2017

Related U.S. Application Data

(63) Continuation of application No. 14/173,166, filed on Feb. 5, 2014, now abandoned.

(30) Foreign Application Priority Data

Feb. 7, 2013 (EP) ..... 13154316

(51) Int. Cl.

| | |
|---|---|
| ***D06F 58/00*** | (2006.01) |
| ***D06F 58/04*** | (2006.01) |
| ***D06F 58/02*** | (2006.01) |
| ***D06F 58/20*** | (2006.01) |
| ***D06F 58/28*** | (2006.01) |

(52) U.S. Cl.

CPC ..... *D06F 58/04* (2013.01); *D06F 58/02* (2013.01); *D06F 58/203* (2013.01); *D06F 58/28* (2013.01); *D06F 2058/2854* (2013.01); *D06F 2058/2877* (2013.01)

(58) Field of Classification Search

CPC ..... D06F 58/02; D06F 58/04; D06F 58/28; D06F 58/203; D06F 2058/2877; D06F 2058/2854

USPC ..... 34/115, 114, 108, 109

See application file for complete search history.

(56) References Cited

U.S. PATENT DOCUMENTS

| | | | | |
|---|---|---|---|---|
| 4,971,449 | A * | 11/1990 | Hendren | B01F 9/06 366/105 |
| 2002/0083743 | A1* | 7/2002 | Uszkureit | D06F 23/06 68/58 |
| 2005/0097926 | A1* | 5/2005 | Kim | D06F 37/06 68/24 |
| 2005/0097927 | A1* | 5/2005 | Kim | D06F 23/06 68/24 |
| 2013/0081432 | A1* | 4/2013 | Choi | D06F 37/06 68/142 |

* cited by examiner

*Primary Examiner* — John P McCormack

(74) *Attorney, Agent, or Firm* — Price Heneveld LLP

(57) ABSTRACT

A domestic clothes dryer comprises a rotating drum defining a drying chamber, an air inlet upstream the drum and at least a hollow lifter mounted in the drum, wherein said hollow lifter is in communication with the air inlet for distributing air inside the drum through a plurality of openings. The air inlet comprises a shaped air plenum chamber facing a lower portion of a rear perforated wall of the drum and capable of delivering air to said lifter and/or directly to the drum through said rear perforated wall.

13 Claims, 4 Drawing Sheets

DOMESTIC CLOTHES DRYER AND METHOD FOR DRIVING SUCH DRYERS

CROSS-REFERENCE TO RELATED APPLICATIONS

The present application represents a continuation application of and claims priority to U.S. patent application Ser. No. 14/173,166, entitled "Domestic Clothes Dryer and Method for Driving Such Dryers", filed Feb. 5, 2014, currently pending, and further claims priority from European Patent Application 13154316.7 filed on Feb. 7, 2013, both of which are incorporated herein by reference in their entirety.

TECHNICAL FIELD

The present disclosure relates to clothes dryers and, more particularly, to clothes dryers that distribute air through one or more lifters.

BACKGROUND

JP-A-9056991 describes a lifter fixed at the periphery part of a rotary drum and cylindrical seals are fixed at the outer periphery of an air intake plenum and of an air exhaust plenum, so that a circulation passage is formed on the back of the rear wall of the drum. The use of two concentric air plenum chambers and related seals makes the above known solution quite complex and not easy to be implemented. Moreover in the above known solution the process hot air is flowing always and entirely through the lifters, even if the lifters are in an upper position during drum rotation. In this condition, i.e. when the lifters are not in contact with clothes, the effectiveness of having air flowing in the lifter is substantially reduced. Another disadvantage of the above known solution is that it cannot be adapted to traditional dryers where air flow enters the drum from a perforated rear wall and leaves the drum from an aperture placed adjacent the front opening of the drum.

SUMMARY

It is an object of this disclosure to provide a tumble clothes dryer that does not present the above disadvantages and which can provider higher drying performances, better fabric care and reduced wrinkles.

The above object is reached thanks to the features listed in the appended claims.

One of the most relevant technical features of a dryer according to this disclosure is the use of a distribution device in the air inlet plenum chamber capable of delivering air to the drum either indirectly, i.e. through one or more lifters, or directly, i.e. though a rear perforated wall of the drum.

According to this disclosure, the distribution device is a shaped air plenum chamber which faces only a lower portion of the rear perforated wall, from its side opposite to the drum, so that air is delivered to the drum only though the lower portion of the rear perforated wall. Therefore, when the position of the lifter during rotation of the drum corresponds to the shaped air plenum chamber, air is flowing entirely or partially through the lifter, and when the position of the lifter does not correspond to said air plenum chamber, air is flowing through the plurality of holes of the rear wall of the drum facing the shaped air plenum chamber. The shape of said plenum chamber, together with the shape of an air conveying base portion of the lifter orthogonal to the active portion of the lifter on the drum side wall (such base portion covering, at a predetermined distance, a part of the perforated rear wall of the drum in order to create a sort of inner chamber) will be responsible on the amplitude of arc during which air is delivered through the lifter.

In one example, the shape of the base portion of the lifter covers substantially a circular sector covering from 60° to 100° of arc of the perforated rear wall of the drum, while the air plenum chamber covers an area a bit wider than said base portion of the lifter, so that at least a percentage of process air flows always through the perforated wall also when the lifter, during its rotation with the drum, it is in a lower portion of the drying chamber. This has been found beneficial in terms of drying efficiency and energy saving.

The use of lifters for blowing air into the drum as described herein can be implemented without significant modification of existing machines. Moreover, as described herein the air is flowing through the lifter only if this latter is aligned with the distribution device (i.e. inlet air plenum chamber). In this way air flows in the lifter only when this latter is in contact with clothes, i.e. in the lower part of its circular trajectory.

Another advantage derives from use of a dedicated cycle and the use of separate actuation for drum tumbling and air blowing that enables energy saving and reduced fabric shrinkage. For instance, the use of "blowing lifters" (i.e. use of lifters though which process air can be fed to the drum) increases significantly the drying evenness with respect to traditional dryers, particularly because air flows where it is needed, towards clothes placed in the bottom of the drum, on the lifter, where in the above known solution most of the air would flow through the upper lifter and only a limited part would flow through clothes therefore reducing significantly the efficiency of the overall drying process.

BRIEF DESCRIPTION OF THE DRAWINGS

Further advantages and features of this disclosure will be clear from the following detailed description, with reference to the attached drawings, in which.

DETAILED DESCRIPTION

Figure 1:
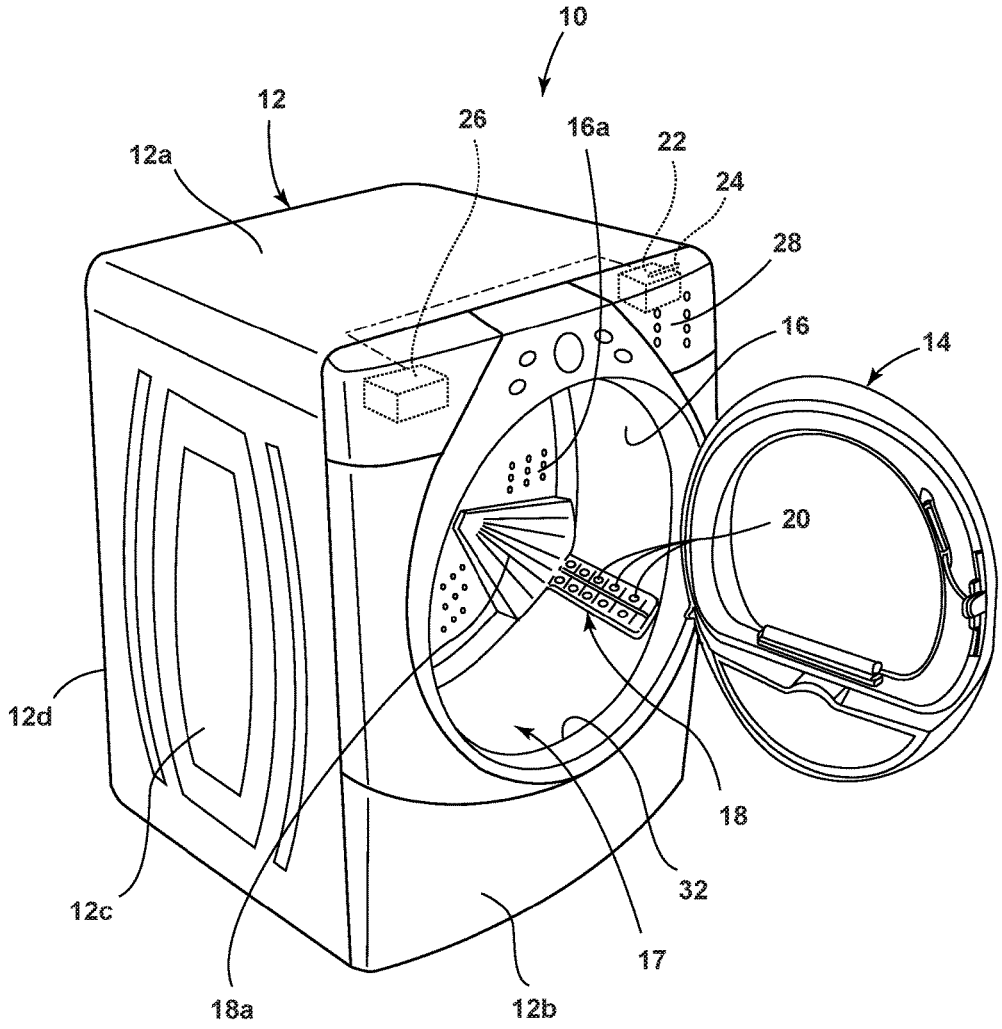
FIG. 1 is an isometric view of an example clothes tumble dryer.
Figure 2:
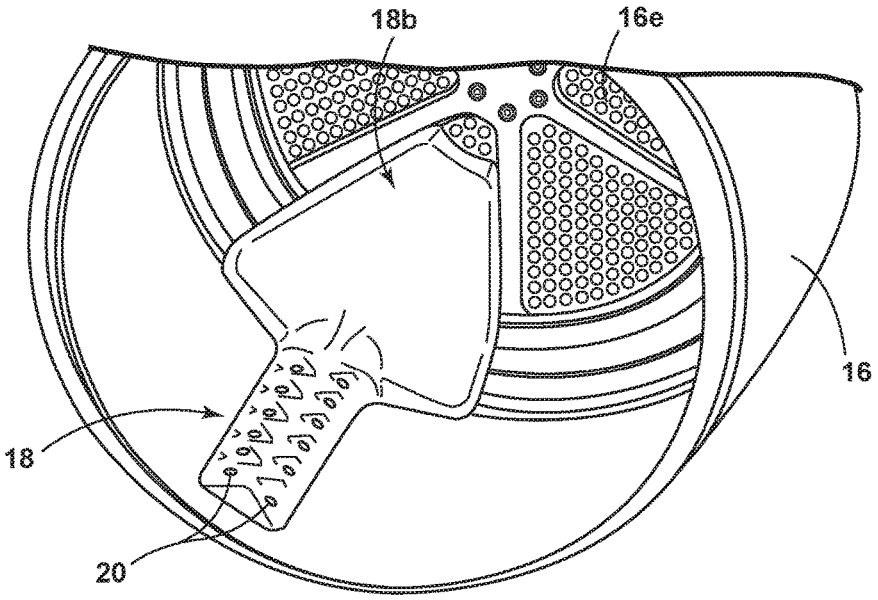
FIG. 2 is an isometric enlarged view of the inside of the drum of FIG. 1.
Figure 3:
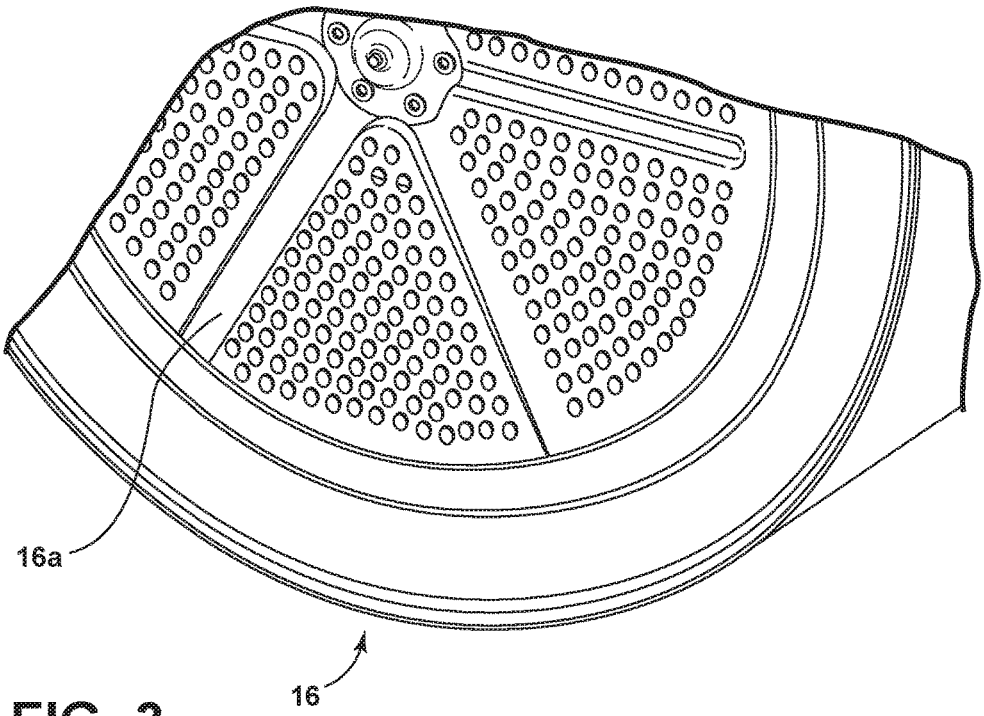
FIG. 3 is an isometric view of the rear of the drum of FIGS. 1 and 2.

With reference to FIG. 1, an example tumble dryer 10 includes a cabinet 12 having an upper wall 12*a*, a front wall 12*b* provided with a hingedly mounted door 14, side walls 12*c* and a rear wall 12*d*. Inside the cabinet 12 a rotating drum 16 is mounted which is actuated by an electric motor (not shown) and which defines a drying chamber 17. The drum 16 includes at least one lifter 18 having a plurality of holes 20 for air passage. The lifter 18 may be hollow. The lifter 18 includes a rear base portion 18*a* covers a portion of a rear perforated wall 16*a* of the drum in order to convey air entering through the perforated wall 17*a* towards the holes 20 of the lifter 18. The rear base portion 18*a* may have a triangular or circular sector shape. The base portion 18*a* defines with the facing portion of the rear wall 16*a* of the drum 16 a sort of inner chamber 19 (see FIG. 4) which covers an arc ranging preferably from 60 to 100° and which communicates with the portion of the lifter 18 fixed to the side wall of the drum 16. The clothes dryer 10 may also have a dispensing system for dispensing treating chemistries into the drum 16, and including a reservoir 22 that is closed by a cover 24. The clothes dryer 10 is also provided with a controller 26 that may receive input from a user through a user interface 28 for selecting a cycle of operation.

Figure 6:
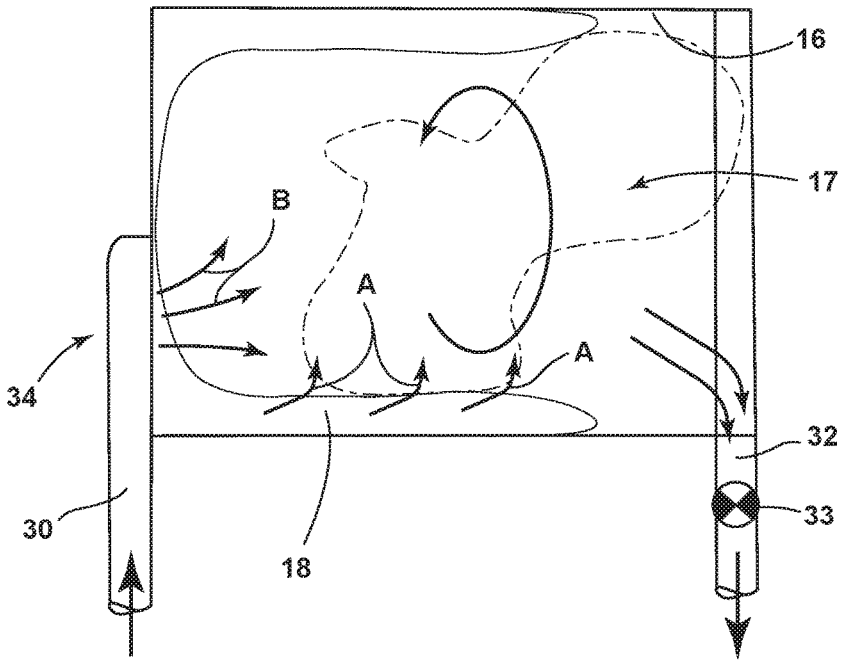
FIG. 6 is a schematic view of how a clothes dryer according to this disclosure works.

The clothes dryer 10 also includes an air inlet channel 30 (see FIG. 6) and an outlet channel 32, a heating system (not shown) that heats air entering the drum (e.g. by means of resistors, heat exchangers, etc.), and a blower (not shown) that makes air flowing across the drum 16.

The drum outlet 32, where a removable filter 33 for removing fluff or lint is placed, can be eventually connected to the drum inlet 30 thus realizing a closed loop system in which heat exchangers, resistors, heat pump, etc. control the condensation and heating process. As an alternative the drum outlet 32 can be connected to an air vent.

The lifter 18 functions not only to increase the heat exchange efficiency between air and clothes and improve the evenness of the drying result by means of clothes redistribution during the whole cycle, but also to improve the efficiency of hot air distribution.

A common drawback of known dryers is that when the load size increases to almost fill the drum volume, the efficiency of the lifter in redistributing the load within the drum is decreased thus leading to the risk of damaging the clothes that are positioned in the rear end of the dryer (where temperatures are higher) and reducing the evenness of drying results.

With a lifter design that allows not only the hot air to flow through the lifter 18 but also by means of a distribution of air through the lifter 18 only during a certain degree of rotation of the drum 16, the temperature gradient in the drum 16 is reduced and the evenness of drying is increased, reducing also the risk of clothes damaging.

Figure 5:
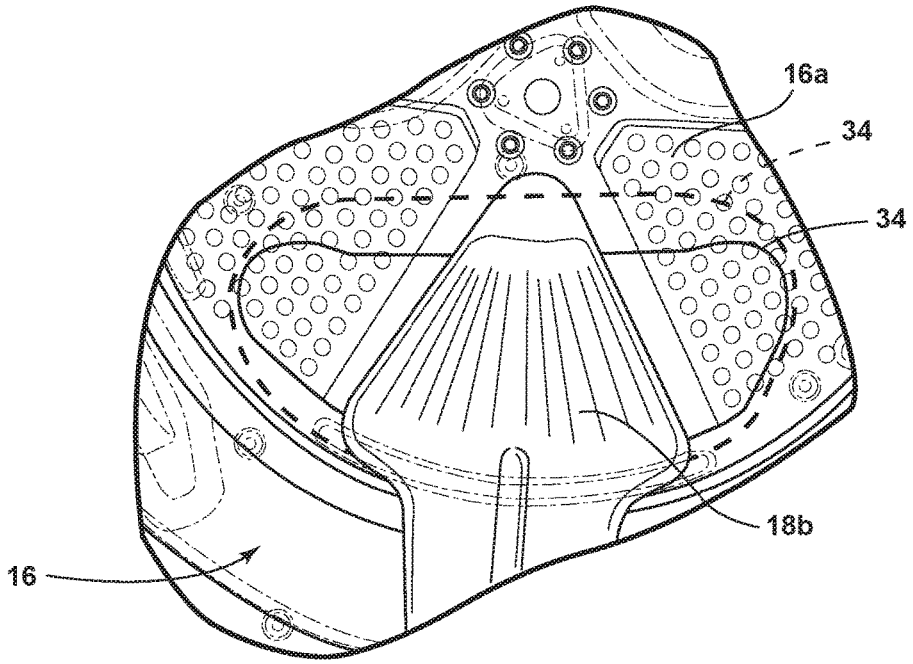
FIG. 5 is a front view of the perforated rear wall of the drum where the shape of the distributor is shown in solid and dotted line.

The above controlled distribution is carried out by means of a shaped fixed distributor 34 which forms an air inlet plenum chamber upstream the drum 16. The shape of the distributor 34 (FIG. 5) does not corresponds necessarily to the circular sector shape of the base portion 18*a* of the lifter 18, but need not extend higher than the lower half of the drum 16. In FIG. 5, two shapes are shown (in dotted and solid lines) which have worked well in tests carried out by the applicants. Such shapes maximize the air flow either though the lifter 18 (when this latter is in the lower positions during rotation) and through clothes adjacent the lifter.

In other examples, the enhanced lifter design can be combined with a dedicated cycle design, able to stop tumbling when the lifter 18 is located in a position that minimizes the temperature gradient. This approach can furthermore increase the above mentioned advantages and can provide also energy saving benefits due to reduced motor usage. One or more lifters of the type disclosed above can also be used together with one or more typical lifters that do not match the above description. Due to the fact that the lifter 18 is physically connected to the drum 16, during tumbling it changes its position with respect to the air inlet 34 thus leading to a variable air mass flow rate in the lifter 18 and in the drum 16. This is clearly shown in FIG. 6 where arrows A show the air flow through the lifter 18 (when this latter is placed in the lower position inside the drum 16), and arrows B show the air flow through the rear wall 16*a* of the drum 16 when the lifter 18 is in a position not matching the air distributor 34. This alternating air flow path in the drum 16 creates the conditions for a variable heat flux as well that improves the evenness of drying and fabric care.

The examples disclosed herein can improve significantly also the drying and fabric care performances with delicate cycles. As described above, aiming to reduce the mechanical action on this type of loads, the tumbling is often reduced or even avoided; this solution has the negative result of increasing the temperature gradient thus leading to the already discussed drawbacks. If the proposed lifter design is used, the machine can be designed to stop tumbling (for the whole cycle or only for part of it, also e.g., using a PWM approach) in a way that the air can flow through the lifter 18 to provide a means to optimize heat flux for these type of loads using appropriate design of the lifter. In some examples, the drum 16 is in a position where the lifter 18 lays on the bottom of the drum 16, thus having the clothes laying on it. The method used to stop the drum 16 in the correct position is well known in the art and it can be easily transferred from the known solutions for top loader washer for having the door in upwards location to facilitate loading and unloading of the drum.

Moreover, since air can flow through the lifter 18, the latter can be designed to host a cartridge containing a fragrance or some other chemical additives to improve quality of drying that can be released in the drum 16.

In some examples, the lifter 18 is used with a drum 16 having an air inlet and outlet port on opposite sides thus enabling fine optimization of heat fluxes. Nevertheless the examples disclosed herein can be applied to those drums in which inlet and outlet air connections are located on the same side (with a dedicated air collector similar to air distributor 34). In these examples the lifter 18 can be used to convey hot inlet air towards the opposite side of the drum 16, therefore improving significantly the heat flux distribution in the longitudinal direction.

Figure 4:
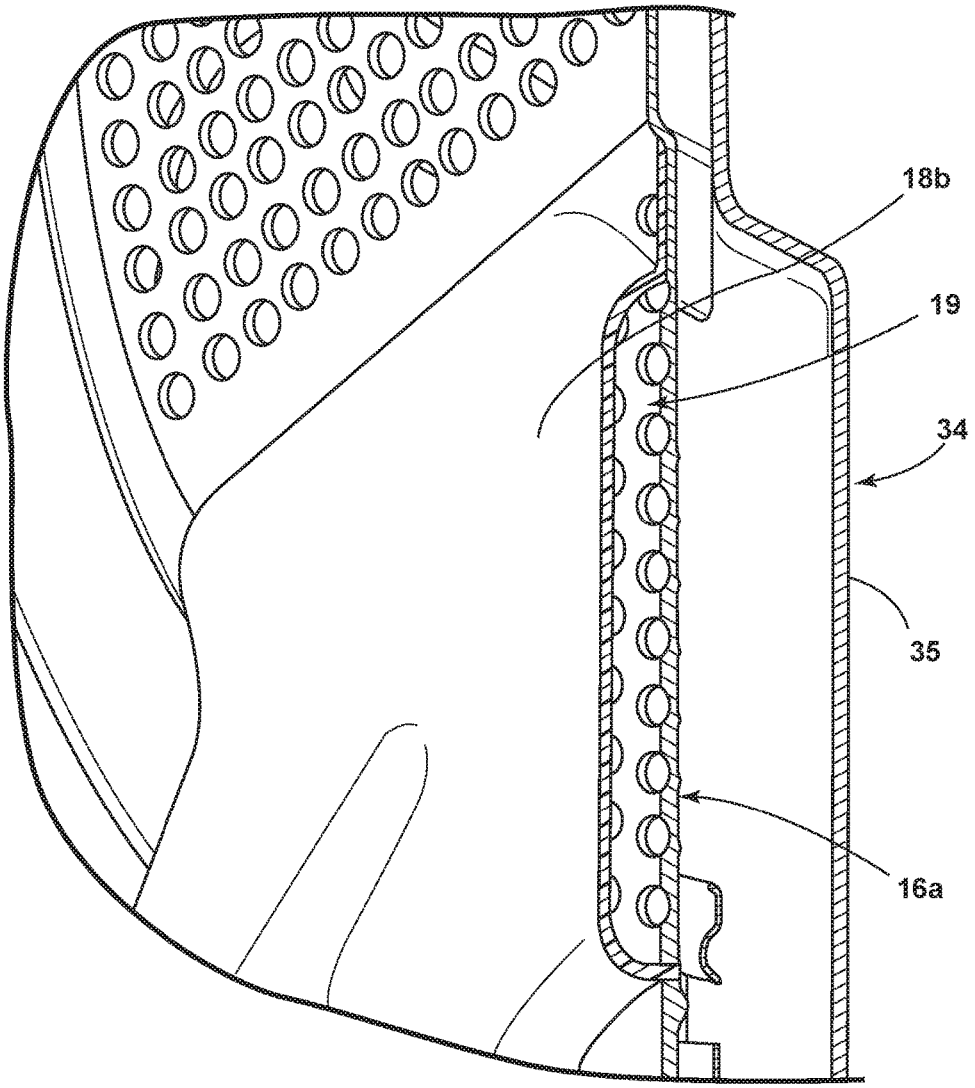
FIG. 4 is a partial cross-sectional view of a detail of FIG. 2.

FIG. 4 shows a detail of the air distributor 34 which is made preferably by a shaped metal or plastic sheet 35. In order to increase the efficiency, a sealing means (not shown) can be interposed between the edge of the shaped sheet 35 forming the distributor 34 and the rear wall 16*a* of the drum 16.

The invention claimed is:

1. A method for drying articles in a dryer including a rotatable drum defining a treating chamber, the rotatable drum having a rear perforated wall and a lifter mounted to the rotatable drum, the lifter having a plurality of openings to convey air from inside the lifter into the rotatable drum and a circular wedge-shaped base portion mounted on a portion of the rear perforated wall of the rotatable drum to create an inner chamber, an air inlet upstream the rotatable drum, the air inlet comprising a shaped air plenum chamber facing a lower portion of the rear perforated wall of the rotatable drum with an upper edge of the shaped air plenum chamber positioned lower than the center of the treating chamber, the method comprising:

rotating the rotatable drum; and distributing air from the air inlet through the rear perforated wall into the circular wedge-shaped base portion of the lifter and through openings in the lifter into the rotatable drum only when the lifter is in a lower portion of the treating chamber and when the circular wedge-shaped base portion of the lifter is aligned with the air inlet where the circular wedge-shaped base portion prevents air distribution from the air inlet directly into the rotatable drum.

2. A method as defined in claim 1, wherein the shaped air plenum chamber has a shape wider than the circular wedge-shaped base portion of the lifter such that a portion of the air is delivered to the rotatable drum through the rear perforated wall near the circular wedge-shaped base portion to direct air towards articles in the vicinity of the lifter.

3. A clothes dryer comprising:

a rotating drum defining a treating chamber, the rotating drum having a rear perforated wall;

a lifter mounted to the rotating drum, the lifter having a plurality of openings to convey air from inside the lifter into the rotating drum and a triangular sector-shaped base portion mounted on a portion of the rear perforated wall of the rotating drum to create an inner chamber;

an air inlet upstream the rotating drum, the air inlet comprising a shaped air plenum chamber facing a lower portion of the rear perforated wall of the rotating drum with an upper edge of the shaped air plenum chamber positioned lower than the center of the treating chamber;

the shaped air plenum chamber delivering air through the rear perforated wall into the triangular sector-shaped base portion of the lifter when the lifter is in a first pre-determined position relative to the shaped air plenum chamber;

the shaped air plenum chamber delivering air through the rear perforated wall directly into the rotating drum when the lifter is in a second pre-determined position relative to the shaped air plenum chamber; and a processor to selectively stop a rotation of the rotating drum when the lifter is in a lower portion of the treating chamber.

4. A clothes dryer as defined in claim 3, wherein the shaped air plenum chamber has a shape substantially corresponding to the shape of the triangular sector-shaped base portion of the lifter.

5. A clothes dryer as defined in claim 3, wherein the triangular sector-shaped base portion has a circular wedge shape.

6. A clothes dryer as defined in claim 3, wherein the triangular sector-shaped base portion covers an arc between 60° and 100°.

7. A clothes dryer as defined in claim 3, wherein the lifter is configured to receive a removable cartridge that contains an additive.

8. A clothes dryer as defined in claim 3, wherein the shaped air plenum chamber has a shape wider than the triangular sector-shaped base portion of the lifter such that a portion of the air is delivered to the rotating drum through the rear perforated wall near the triangular sector-shaped base portion to direct air towards articles in the vicinity of the lifter when the rotation of the rotating drum has been stopped by the processor.

9. A clothes dryer as defined in claim 3, wherein the triangular sector-shaped base portion tapers away from the rear perforated wall.

10. A method for drying articles in a dryer including a rotatable drum defining a treating chamber, the rotatable drum having a rear perforated wall and a lifter mounted to the rotatable drum, the lifter having a plurality of openings to convey air from inside the lifter into the rotatable drum and a triangular sector-shaped base portion mounted on a portion of the rear perforated wall of the rotatable drum to create an inner chamber, an air inlet upstream the rotatable drum, the air inlet comprising a shaped air plenum chamber facing a lower portion of the rear perforated wall of the rotatable drum with an upper edge of the shaped air plenum chamber positioned lower than the center of the treating chamber, the method comprising:

rotating the rotatable drum;

distributing air from the air inlet through the rear perforated wall into the triangular sector-shaped base portion of the lifter and through openings in the lifter into the rotatable drum with the triangular sector-shaped base portion blocking air delivery through the rear perforated wall directly into the rotatable drum when the triangular sector-shaped base portion is aligned with the air inlet;

blocking air from entering the lifter from the air inlet and distributing air from the air inlet directly into the rotatable drum bypassing the lifter when the lifter is in an upper portion of the treating chamber; and stopping rotation of the rotatable drum for a pre-determined period of time when the lifter is in a lower portion of the treating chamber and the triangular sector-shaped base portion is aligned with the air inlet.

11. A method as defined in claim 10, further comprising starting and stopping the rotatable drum when the lifter is in the lower portion according to a predetermined pattern.

12. A method as defined in claim 10, further comprising maintaining the rotatable drum in the stopped position for all of a drying cycle.

13. A method as defined in claim 10, wherein the shaped air plenum chamber has a shape wider than the triangular sector-shaped base portion of the lifter such that a portion of the air is delivered to the rotatable drum through the rear perforated wall near the triangular sector-shaped base portion to direct air towards articles in the vicinity of the lifter.

* * * * *